US008863407B2

(12) United States Patent
Nishiwaki et al.

(10) Patent No.: US 8,863,407 B2
(45) Date of Patent: Oct. 21, 2014

(54) SHOE SOLE OF ATHLETIC SHOE WITH HIGH RUNNING EFFICIENCY

(75) Inventors: Tsuyoshi Nishiwaki, Hyogo (JP); Seigo Nakaya, Hyogo (JP); Kenta Moriyasu, Hyogo (JP); Hisanori Fujita, Hyogo (JP)

(73) Assignee: Asics Corporation, Hyogo (JP)

( * ) Notice: Subject to any disclaimer, the term of this patent is extended or adjusted under 35 U.S.C. 154(b) by 842 days.

(21) Appl. No.: 13/120,562

(22) PCT Filed: Sep. 30, 2008

(86) PCT No.: PCT/JP2008/067710

§ 371 (c)(1),
(2), (4) Date: Apr. 22, 2011

(87) PCT Pub. No.: WO2010/038266

PCT Pub. Date: Apr. 8, 2010

(65) Prior Publication Data

US 2011/0185590 A1 Aug. 4, 2011

(51) Int. Cl.

| | |
|---|---|
| ***A43B 13/18*** | (2006.01) |
| ***A43B 5/06*** | (2006.01) |
| ***A43B 7/24*** | (2006.01) |
| ***A43B 13/02*** | (2006.01) |
| ***A43B 13/12*** | (2006.01) |
| ***A43B 13/14*** | (2006.01) |

(52) U.S. Cl.

CPC ..... *A43B 5/06* (2013.01); *A43B 13/183* (2013.01); *A43B 7/24* (2013.01); *A43B 13/026* (2013.01); *A43B 13/12* (2013.01); *A43B 13/141* (2013.01); *A43B 13/181* (2013.01); *A43B 13/187* (2013.01)

USPC ..... 36/27; 36/28; 36/25 R

(58) Field of Classification Search

CPC .. A43B 13/181; A43B 13/183; A43B 13/187; A43B 13/12; A43B 13/141; A43B 7/24; A43B 5/06; A43B 13/188; A43B 13/026; A43B 3/0057

USPC ..... 36/27, 28, 25 R, 35 R, 32 R

See application file for complete search history.

(56) References Cited

U.S. PATENT DOCUMENTS 6,694,642 B2 2/2004 Turner
7,290,357 B2 * 11/2007 McDonald et al. ..... 36/102

(Continued)

FOREIGN PATENT DOCUMENTS

GB 2431857 A * 5/2007
JP 10-108704 A 4/1998

(Continued)

OTHER PUBLICATIONS

International Search Report for corresponding International Application No. PCT/JP2008/067710 mailed Dec. 22, 2008.

(Continued)

*Primary Examiner* — Ted Kavanaugh
(74) *Attorney, Agent, or Firm* — Renner, Otto, Boisselle & Sklar, LLP

(57) ABSTRACT

An athletic shoe suitable for efficient running. A depression is formed in the rear foot portion which extends forward from the calcaneal bone and which does not contact the ground. A band-like area is provided in the middle foot portion extending in the front-rear direction in the central portion between the medial side and the lateral side of the shoe sole so as to be continuous with the depression. The reinforcement member and the midsole are provided in the middle foot portion so that the upper surface of the midsole less easily sinks downward due to a load from above on the medial side than in the band-like area and on the lateral side. In the front foot portion, a longitudinal groove is formed which extends in the front-rear direction in the central portion of the midsole body so as to be continuous with the band-like area. The longitudinal groove is curved so as to be generally parallel to the lateral edge of the front foot portion of sole.

21 Claims, 11 Drawing Sheets

(56) References Cited

U.S. PATENT DOCUMENTS

| | | | | |
|---|---|---|---|---|
| 7,941,941 | B2 * | 5/2011 | Hazenberg et al. | 36/28 |
| 8,166,672 | B2 * | 5/2012 | Murphy et al. | 36/28 |
| 2007/0193065 | A1 | 8/2007 | Nishiwaki et al. | |
| 2009/0013556 | A1 | 1/2009 | Nishiwaki et al. | |
| 2010/0005684 | A1 | 1/2010 | Nishiwaki et al. | |

FOREIGN PATENT DOCUMENTS

| | | | |
|---|---|---|---|
| JP | 2000-333705 | A | 12/2000 |
| JP | 2001-346605 | A | 12/2001 |
| JP | 2002-034605 | A | 2/2002 |
| JP | 2008-029717 | A | 2/2008 |
| WO | 2006/120749 | A1 | 11/2006 |
| WO | 2008/047538 | A1 | 4/2008 |

OTHER PUBLICATIONS

Reply to Written Opinion for corresponding International Application No. PCT/JP2008/067710 (English translation) mailed Apr. 24, 2009.

* cited by examiner

C
13
5
2,20
13
5
Y
10
L
5
12
M
5
1F
10
2e
C
11
2d,20d
10
M
5
5
11
10
VA
VA
1
5
C
L
4
D2
9
1M
D1
33
1
VB
VB
32
20
33
33
20
X
49
31
3
5
C
1Rm
1R
VC
VC
5
L
5
M
7
39
8
R
5
5

SHOE SOLE OF ATHLETIC SHOE WITH HIGH RUNNING EFFICIENCY

TECHNICAL FIELD

The present invention relates to a shoe sole of an athletic shoe suitable for efficient running.

BACKGROUND ART

Japanese Laid-Open Patent Publication No. 2008-29717 discloses a structure of a shoe sole that urges the rolling action during walk. The shoe sole disclosed in this document has a narrow groove that is continuous from the rear foot portion to the front foot portion.

[First Patent Document] 2008-29717 (Abstract)

However, this conventional technique aims at increasing walking efficiency of elderly people and infants, and would not increase running efficiency as can be seen from description below.

US2007/0193065A1 and WO2006/120749A1 disclose a resin part formed in a U-letter shape extending from the rear foot portion to the middle foot portion.

However, the resin part disclosed in these documents has a generally equal strength on the medial side and on the lateral side of the foot. No longitudinal groove is formed in the front foot portion of the shoes of these documents.

The shoe sole disclosed in WO2008/047538A1 has a depression in the front foot portion and in the rear foot portion. However, the depression in the front foot portion is not parallel to the outer edge of the front foot portion, but is formed along the medial-lateral center line of the front foot portion.

The shoe sole of this document does not have a flexible band-like area in the medial-lateral central portion of the middle foot portion.

U.S. Pat. No. 6,694,642 discloses a cup sole having a through hole in the central portion of the rear foot portion.

The shoe sole disclosed in Japanese Laid-Open Patent Publication No. 2000-333705 has a depression in the central portion of the rear foot portion, and the medial side of the midsole is harder than the lateral side thereof in the middle foot portion. However, no longitudinal groove is provided in the front foot portion.

Japanese Laid-Open Patent Publication No. 2001-346605 discloses forming a groove in the front foot portion of the outsole.

DISCLOSURE OF THE INVENTION

The documents above do not disclose a structure of a shoe sole that promotes smooth forward movement of the load center from the rear foot portion to the front foot portion of the shoe sole during run to thereby increase the running efficiency.

Principles of Invention

In a walking or running action where one lands on the heel and takes off at the tiptoe (toe tip), the center of the load on the foot sole moves from the lateral side of the heel through the middle foot portion to the medial side of the tiptoe. By providing a groove on the lower surface of the shoe sole along the trace of movement of the load center, it is expected that the load center is guided along the groove to thereby improve the walking or running efficiency.

As a result of a research by the present inventors, it has been confirmed by computer simulation that the upper surface of the midsole on the opposite side to the lower surface, on which the groove is provided, of the shoe sole sinks more downward than other portions in a cross section of the shoe sole.

On the other hand, Japanese Laid-Open Patent Publication No. 2008-29717 discloses that formation of a groove at a predetermined position along the longitudinal direction of the shoe sole makes it easier for elderly people and infants to walk.

However, as will be described later, the trace of movement of the load center during walk is considerably different from that during run.

That is, the present inventors conducted the following test to obtain the trace of movement during run which is different from that during walk, thereby completing the present invention.

First, a groove 100 shown in FIGS. 1A and 1B was formed on a marathon running shoe whose shoe sole has a flexible reverse surface. Then, markers 102 were bonded at ten positions along the periphery of the shoe.

On a track provided with a plate for measuring the center of the load, a subject walked at 8 min/km, and the trace of movement of the load center during walk was measured. The trace of movement 101 is shown in FIG. 1A.

On the other hand, the same subject ran on the same track at 3.5 min/km, and the trace of movement 101 of the load center during run was measured. The trace of movement 101 is shown in FIG. 1B.

The following is assumed from this test.

The trace of movement 101 during walk is substantially different from that during run. Particularly, stagnation and variations of the trace of movement 101 are observed during run for the following points in time and points in place.

i) vicinity of the center of the heel upon first strike (instant of landing)

ii) the medial side of the middle foot portion iii) vicinity of the center of the tiptoe upon takeoff The stagnation and variations of the trace of movement 101 occur when the load center is not smoothly moving forward. Therefore, by suppressing or preventing the stagnation and variations of the trace of movement 101, the load center smoothly moves forward and efficient running is expected.

The points (i) to (iii) during run will be discussed below in terms of improving the running efficiency.

First discussing the first strike, the landing impact upon the shoe sole at this point is great. Therefore, it is necessary to substantially deform the lateral side of the rear foot portion which first contacts the ground so as to quickly guide the load center to the vicinity of the center of the heel. It is speculated that a large depression is necessary in the vicinity of the center of the heel for this.

Next, the middle foot portion will be discussed.

After the heel lands, as the load center moves to the middle foot portion in front of the heel, the foot leans toward the medial side of the middle foot portion, as shown in FIG. 1B. Therefore, on the medial side of the middle foot portion, the trace of movement 101 curves and the load center stagnates. The curve and the stagnation significantly lower the running efficiency. In order to prevent or suppress this, it is speculated that merely forming the groove 100 in the middle foot portion is hardly helpful, and it is necessary to suppress the leaning of the foot. Therefore, it is assumed that the load center can be smoothly guided forward by preventing the medial side of the arch from dropping (sinking) in the middle foot portion.

Next, the tiptoe takeoff action will be discussed.

At takeoff, the force acting upon the road surface from the shoe sole is small. Nevertheless, the running efficiency is likely to improve easily if the direction in which one kicks out the tiptoe becomes stable.

The trace of movement 101 at takeoff is unstable during the run of FIG. 1B. In order to stabilize this, it would be necessary that the shoe sole bends at a predetermined position along the bone structure of the tiptoe even though the force acting upon the shoe sole is small.

According to these principles, there is proposed an athletic shoe having a shoe sole of a novel structure.

A shoe sole of an athletic shoe according to one aspect of the present invention is a shoe sole of an athletic shoe suitable for efficient running, wherein: the shoe sole has a front foot portion, a middle foot portion and a rear foot portion continuous with one another in a front-rear direction of a foot, and has a medial side, a lateral side and a central portion between the medial side and the lateral side continuous with one another in a width direction of the foot, the shoe sole comprising: a midsole having an upper surface and a lower surface and absorbing an impact of landing; and an outsole placed below the midsole; the midsole includes a midsole body formed by a foamed resin in the front foot portion; the outsole is provided in the front foot portion and the rear foot portion; the middle foot portion supports an arch of the foot, and a reinforcement member is provided in the middle foot portion for suppressing lowering of the arch; a depression is formed in the rear foot portion which extends forward from a calcaneal bone and which does not contact a ground; a band-like area is provided in the middle foot portion extending in the front-rear direction in the central portion so as to be continuous with the depression; the reinforcement member and the midsole are provided in the middle foot portion so that the upper surface of the midsole less easily sinks downward due to a load from above on the medial side than in the band-like area and on the lateral side; in the front foot portion, a longitudinal groove is formed in the midsole body and the outsole which extends in the front-rear direction in the central portion so as to be continuous with the band-like area; a depth of the longitudinal groove is 5 mm to 20 mm; the longitudinal groove is provided to extend from a rear end of the front foot portion to a proximal interphalangeal joint of a second toe; the longitudinal groove is curved so as to be generally parallel to a lateral edge of the front foot portion of the midsole; a width and the depth of the longitudinal groove are smaller than those of the depression; and the depression, the band-like area and the longitudinal groove are smoothly continuous with one another in the front-rear direction.

Since the upper surface of the midsole lowers in the depression, the band-like area and the groove, the load center smoothly moves forward because of these members.

Particularly, the upper surface of the midsole of the middle foot portion less easily sinks downward on the medial side than in the center and on the lateral side, and it is therefore possible to suppress the movement of the load center to the medial side of the middle foot portion. Therefore, one can expect smooth forward movement of the load center. This, as a result allows for efficient running.

When one takes off at the tiptoe of the front foot portion, the shoe sole bends at the longitudinal groove extending along the lateral edge of the front foot portion. Thus, the shoe sole is easily bent at a predetermined position along tiptoe joints. This makes smooth the action of kicking out diagonally forward toward the lateral side.

Herein, "the depth of the longitudinal groove being 5 mm to 20 mm" means that the average value among deepest portions of the longitudinal groove is 5 mm to 20 mm, and means that the value obtained by integrating the depth of deepest positions along the lateral cross section of the longitudinal groove in the direction in which the longitudinal groove extends, and then dividing the integrated value by the length of the longitudinal groove, is 5 mm to 20 mm.

Therefore, there may locally be some portions over 20 mm or less than 5 mm among the deepest portions of the longitudinal groove.

As the structure of the reinforcement member and the midsole in the middle foot portion, various structures (reinforcement means) as follows may be employed solely or in combination.

As such a structure, a reinforcement member may be employed which has a large rigidity on the medial side and a small rigidity in the band-like area and on the lateral side. For example, in the middle foot portion, the reinforcement member placed on the lower surface of the midsole is thick on the medial side of the lower surface while it is thin, or has a through hole, in the band-like area and on the lateral side of the lower surface.

Still another structure is a structure where the thickness of the midsole body is larger on the medial side and smaller in the band-like area and on the lateral side. In such a case, the midsole body may be divided into upper and lower pieces. One of the separated upper and lower pieces of the midsole body may be provided on the medial side of the middle foot portion while being absent in the band-like area and on the lateral side of the middle foot portion.

Still another structure is a structure where the reinforcement member is bonded on the medial side of the lower surface of the midsole while it is spaced apart from the lower surface of the midsole body and is not bonded to the lower surface in the band-like area. A structure of this type is disclosed in WO2005/037002, disclosure of which is incorporated herein by reference in its entirety.

The reinforcement member may be provided in two, upper and lower, layers only on the medial side, with only one layer provided in the band-like area and on the lateral side.

In the present invention, "the depth of a groove or a depression" means the distance from the ground contact surface (tread surface) to the lower surface of the midsole. On the other hand, whether "the width is small" should be determined by comparing average widths of grooves and depressions.

Where the depth of a groove is less than 5 mm, the load center is unlikely to be localized in the groove portion in the front foot portion. On the other hand, where the depth of a groove is over 20 mm, the front foot portion may become too thick, or one may feel as if the front foot portion were split into medial and lateral pieces, resulting in unstable support of the front foot portion.

Note, however that the depth of a groove may locally be smaller than 5 mm or may locally be deeper than 20 mm.

In view of this, the depth of a groove is preferably 5 mm to 15 mm, and most preferably about 7 mm to about 13 mm.

In the present invention, the width of a depression is preferably about 10 mm to about 60 mm, and more preferably about 12 mm to about 50 mm. Note that the depression may be a groove-like structure elongated in the longitudinal direction.

In a preferred embodiment of the present invention, it further includes: a support member made of a non-foamed resin, having such a shape that it is rolled up along the medial side and the lateral side of the rear foot portion, and supporting the foot in the rear foot portion, wherein: the support member includes a through hole portion for assisting in making it easier for the upper surface of the midsole to sink downward in a central portion of the rear foot portion.

In such a case, the support member makes stable the support of the foot sole while supporting the medial side and the lateral side of the rear foot portion, thereby reliably ensuring that the upper surface of the midsole sinks downward above the depression.

The through hole portion may be formed by a plurality of through holes, as well as by a single large through hole, or may be formed in a grid (mesh) pattern. The through hole portion may be formed by forming the support member in a U-letter shape.

The through hole portion is provided at least in a portion directly below the calcaneal bone, and is preferably provided in an area including the center of the calcaneal bone.

In another preferred embodiment of the present invention, it further includes: a support member extending from the rear foot portion toward the middle foot portion, supporting the medial side of the foot in the middle foot portion, and supporting the lateral side of the foot in the rear foot portion, wherein: the support member forms a part or whole of the reinforcement member in the middle foot portion; and the support member includes a through hole portion for assisting in making it easier for the upper surface of the midsole to sink downward in a central portion of the middle foot portion and the rear foot portion.

In this embodiment, the support member makes stable the support of the foot sole while supporting the medial side and the lateral side of the rear foot portion and the middle foot portion, thereby reliably ensuring that the upper surface of the midsole sinks downward in the depression and the band-like area.

The support member extending from the rear foot portion to be continuous with the middle foot portion will serve to realize smooth forward movement of the load center.

Herein, "to support" means that the support member is placed on the lower surface of the midsole body, and the support member does not have to be bonded to the lower surface.

In this embodiment, more preferably, a bridge piece, forming a part of the reinforcement member, is provided so as to bridge between the rear end of the front foot portion of the midsole body and a front end of the rear foot portion, and the bridge piece serves to make it less easy for the medial side of the middle foot portion to sink downward than the band-like area.

In such a case, the medial side of the middle foot portion is reinforced by the bridge piece, and therefore the upper surface of the midsole more easily sinks downward in the band-like area than on the medial side of the middle foot portion. Thus, the running efficiency is further improved.

In another more preferred embodiment, the midsole further includes the midsole body in the middle foot portion; and the support member is bonded to the lower surface of the midsole body on the medial side of the middle foot portion, and is not bonded to the lower surface of the midsole body and is spaced apart from the lower surface of the midsole body on the lateral side of the middle foot portion.

In such a case, the support member is spaced apart from the lower surface of the midsole body on the lateral side of the midsole body. Therefore, the midsole body easily sinks downward. On the medial side of the middle foot portion where the midsole body is supported by the support member, the upper surface of the midsole less easily sinks downward than on the lateral side of the middle foot portion. Therefore, it is likely that the load center smoothly moves forward in the middle foot portion.

In another more preferred embodiment, the support member further includes a slant portion extending diagonally forward from the lateral side toward the medial side in the band-like area of the middle foot portion; and bending of the middle foot portion in a first direction along a direction in which the slant portion extends requires a larger force than bending of the middle foot portion in a second direction perpendicular to the first direction.

In such a case, the slant portion suppresses bending of the middle foot portion diagonally forward to the medial side. Therefore, it is possible to suppress movement of the load center to the medial side of the middle foot portion.

In such a case, the through hole portion of the support member includes a plurality of through holes parallel to one another extending diagonally forward from the lateral side toward the medial side in the band-like area of the middle foot portion, and a plurality of the slant portions are formed along the through holes.

In another preferred embodiment of the present invention, a first transverse (lateral) groove along a metatarsal phalangeal joint (MP joint) is provided in the front foot portion so as to extend across the outsole; and the first transverse groove divides the outsole in a front-rear direction.

In such a case, the bending of the foot at the MP joint is made smooth, and it is likely that the load center moves along the longitudinal groove.

In such a case, it is more preferred that a second transverse groove extending in a direction across the outsole between a tip of a fifth toe and a tip of a third toe is provided on a lateral side of the front foot portion; and the second transverse groove is formed so as to be more spaced apart from the first transverse groove as it extends toward a lateral edge of the midsole.

The second transverse groove will make smooth the bending of the interphalangeal joint of the tiptoe so that the trace of movement at takeoff is likely to be stable.

In still another preferred embodiment of the present invention, the longitudinal groove is formed so that a width and a depth thereof gradually and smoothly increase from a front end of the longitudinal groove toward the middle foot portion.

In such a case, the load center will likely be guided along the longitudinal groove from the middle foot portion to the front foot portion.

In a preferred embodiment of the present invention, the reinforcement member includes a first member attached to the lower surface of the midsole body on the medial side of the middle foot portion to support the medial side of the foot, and a second member placed below the first member on the medial side of the middle foot portion.

In such a case, it is possible to easily realize a structure where the upper surface of the midsole on the medial side of the middle foot portion less easily lowers, while one is unlikely to feel an upthrust on the medial side of the middle foot portion as the medial side of the middle foot portion is reinforced by two members.

In another preferred embodiment of the present invention, a soft, shock-absorbing element having a smaller Young's modulus than the foamed material is placed on the lateral side of the rear foot portion as a part of the midsole; and a division groove dividing the outsole and the shock-absorbing element along a radial direction extending in a diagonally rearward direction from a center of a heel is provided on the lateral side of the rear foot portion.

In such a case, the soft, shock-absorbing element undergoes substantial compressive deformation upon first strike, and the load center moves toward the center of the heel as it is guided along the division groove which divides the outsole.

Therefore, it is possible to suppress stagnation of the load center in the rear foot portion upon first strike. As a result, the running efficiency is improved.

DESCRIPTION OF THE REFERENCE NUMERALS

Figure 1A:
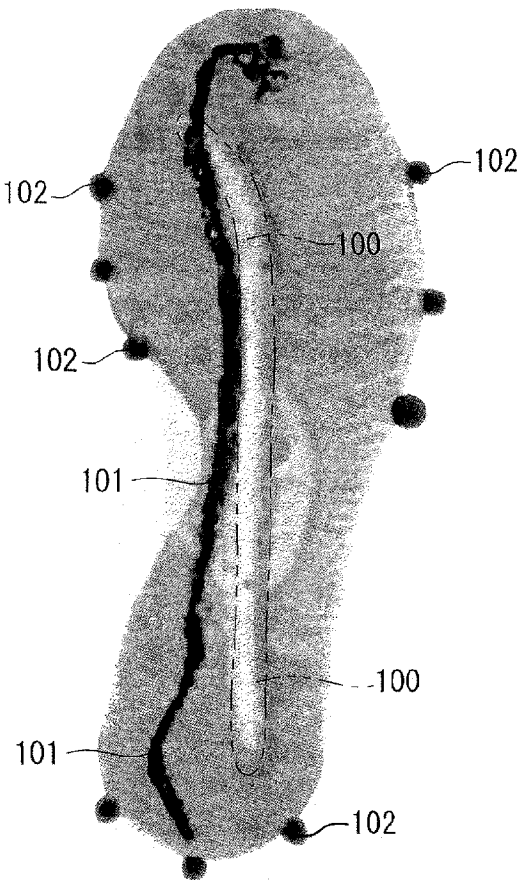
FIG. 1A is a plan view showing a shoe sole of a comparative example together with the trace of movement obtained when one walks wearing the shoe sole.
Figure 1B:
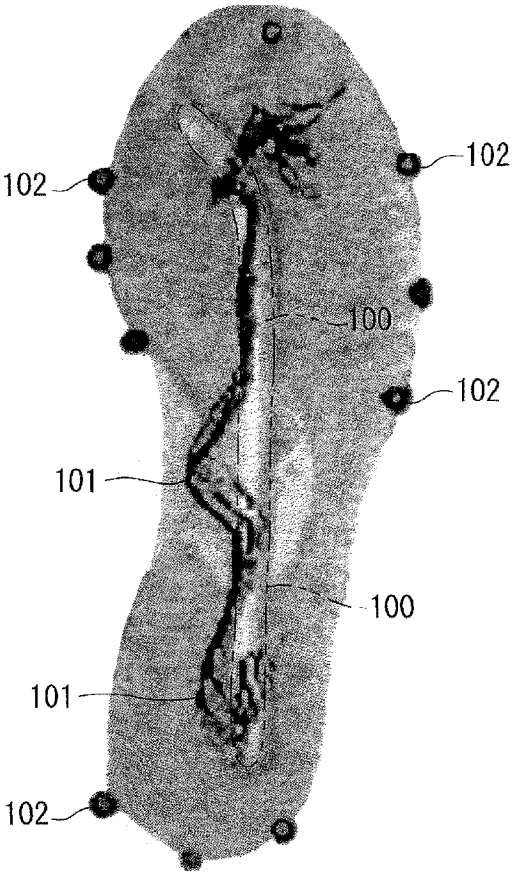
FIG. 1B is a plan view showing the shoe sole together with the trace of movement obtained when one runs wearing the shoe sole.

1: Upper
2: Midsole
20: Midsole body
21: Shock-absorbing element
2*e*: Lateral edge
2*u*: Upper surface
2*d*: Lower surface
20*d*: Lower surface
3: Heel cup
30: Support portion
31: First through hole
32: Second through hole
33: Slant portion
39, 49: Attachment portion
4: Bridge piece
5: Outsole
50: Bonded surface
51: Ground contact surface
7: Division groove
8: Depression
9: Band-like area
10: Longitudinal groove
11: First transverse groove
12: Second transverse groove
13: Extension groove
1F: Front foot portion
1M: Middle foot portion
1R: Rear foot portion
1Rm: Central portion
1T: Tiptoe portion
R: Radial direction
Y: Front-rear direction
X: Width direction
D: Depth
W: Width
M: Medial side
L: Lateral side
C: Central portion
D1: First direction
D2: Second direction
Δ1: First gap
Δ2: Second gap
G: Load center

BEST MODE FOR CARRYING OUT THE INVENTION

The present invention will be understood more clearly from the following description of preferred embodiments taken in conjunction with the accompanying drawings. Note however that the embodiments and the drawings are merely illustrative, and the scope of the present invention shall be defined by the appended claims. In the accompanying drawings, like reference numerals denote like components throughout the plurality of figures.

An embodiment of the present invention will now be described with reference to FIGS. 1C to 11.

Figure 10:
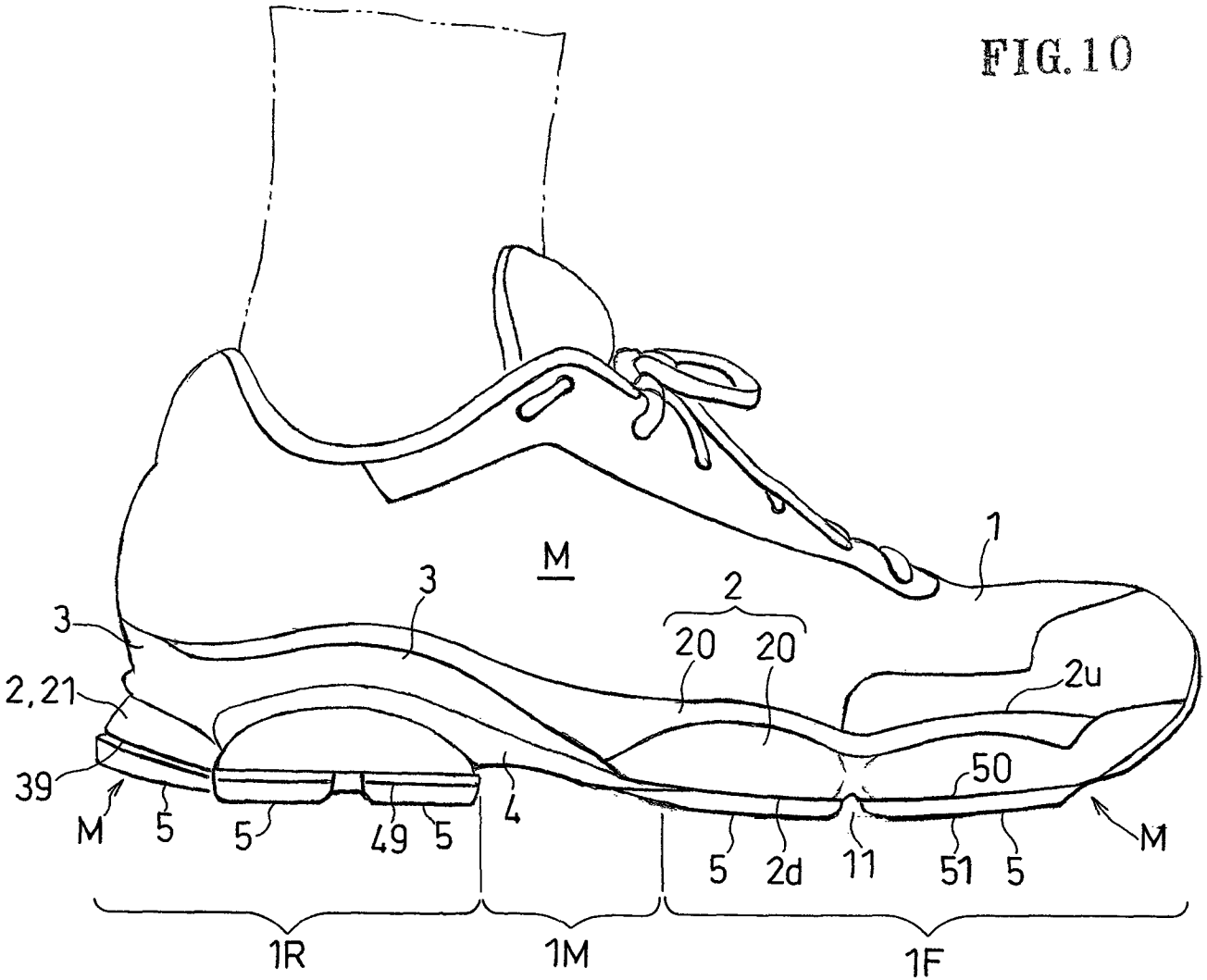
FIG. 10 is a medial side view of the shoe.
Figure 11:
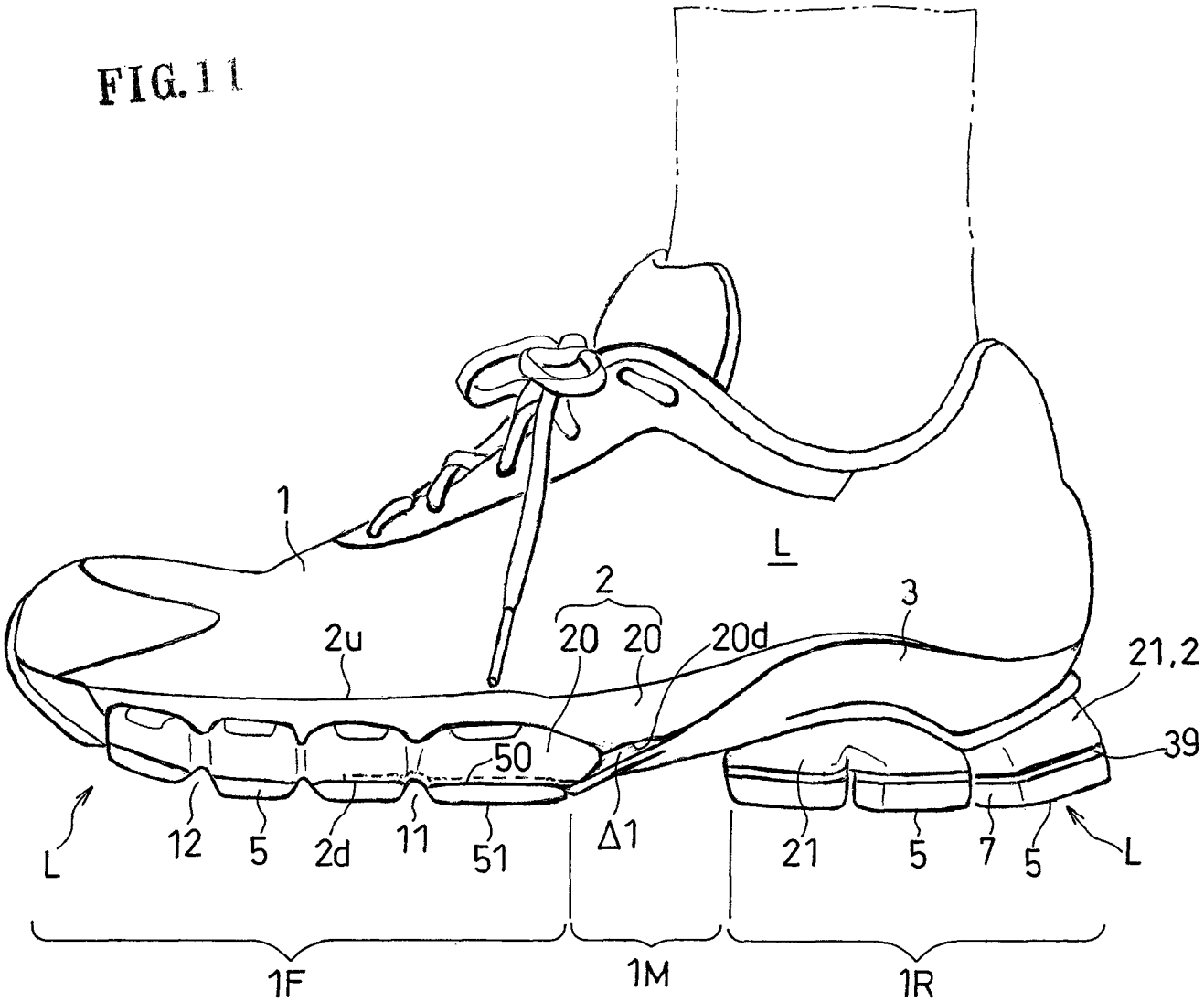

In FIGS. 10 and 11, the present athletic shoe includes an upper 1 that wraps around the instep, a midsole 2, a heel cup 3, an outsole 5, etc.

The midsole 2 includes an upper surface 2*u* and a lower surface 2*d*, and absorbs the impact of landing. The outsole 5 has a bonded surface 50 to be bonded to the lower surface 2*d* of the midsole 2, and a ground contact surface 51 to be in contact with the road surface.

Figure 8:
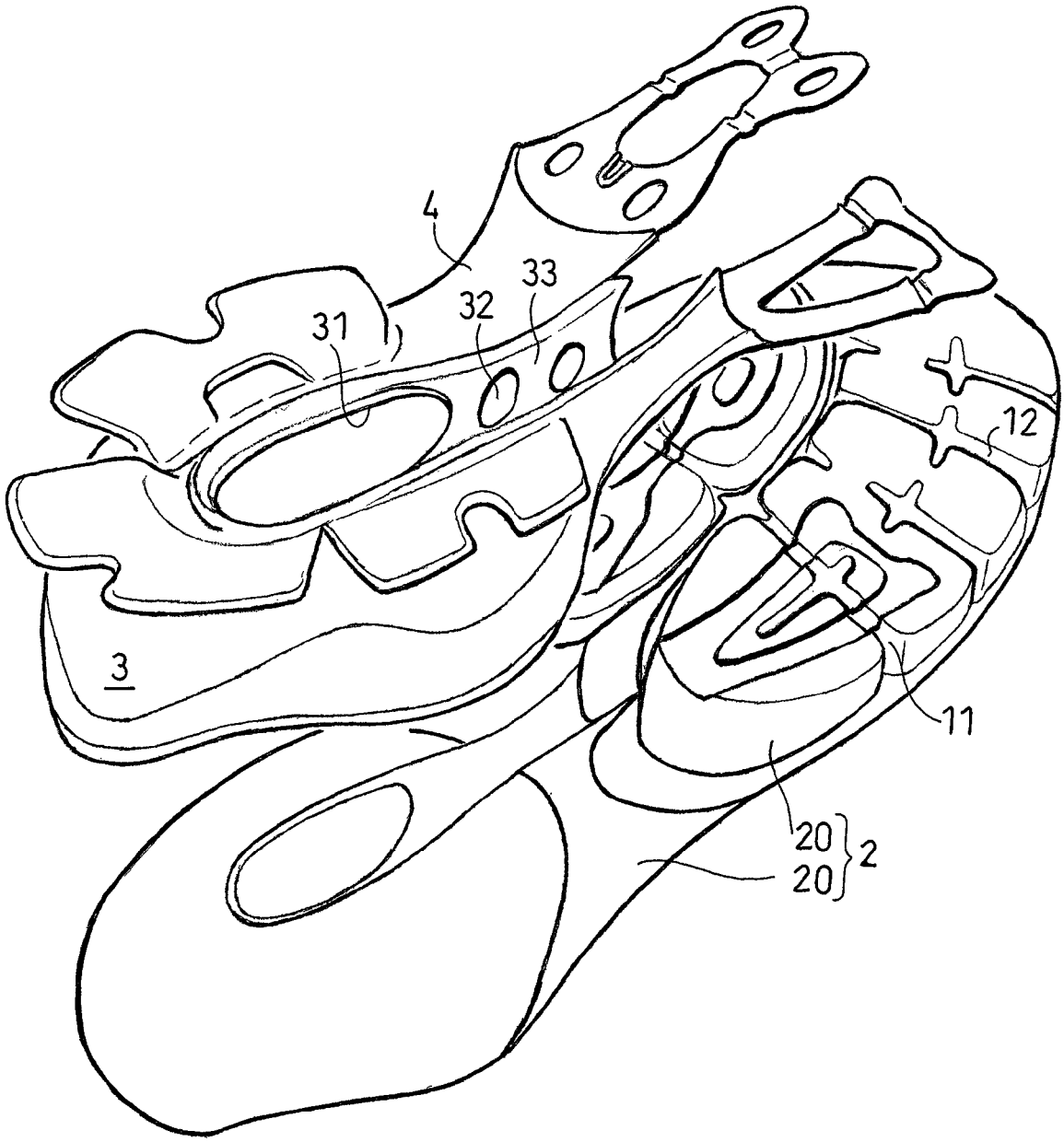
FIG. 8 is an exploded perspective view showing the shoe sole with the outsole removed.

As shown in FIG. 8, the midsole 2 includes a midsole body 20 formed by a foamed resin such as EVA, for example, extending across the entire area of a front foot portion 1F, a middle foot portion 1M and a rear foot portion 1R (FIG. 10). As shown in FIG. 5C, in the rear foot portion 1R, a rubber-like shock-absorbing element 21, called a gel, of the midsole 2 is placed below the midsole body 20 and the heel cup 3. The shock-absorbing element 21 has a smaller Young's modulus than the foamed material of the midsole 2.

Figure 5A:
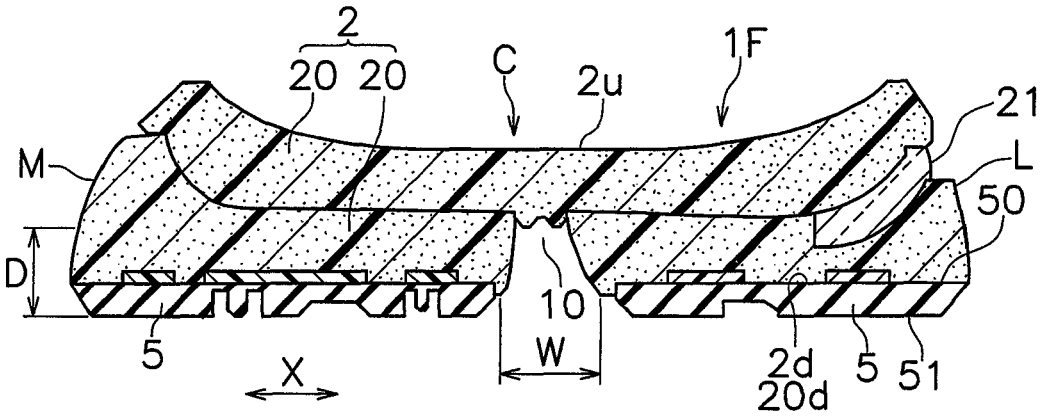
FIG. 5A is a cross-sectional view taken along line VA-VA of FIG. 2.

As shown in FIG. 5A, in the front foot portion 1F, the midsole body 20 may be divided into upper and lower pieces so as to place the shock-absorbing element 21 therebetween.

Figure 5B:
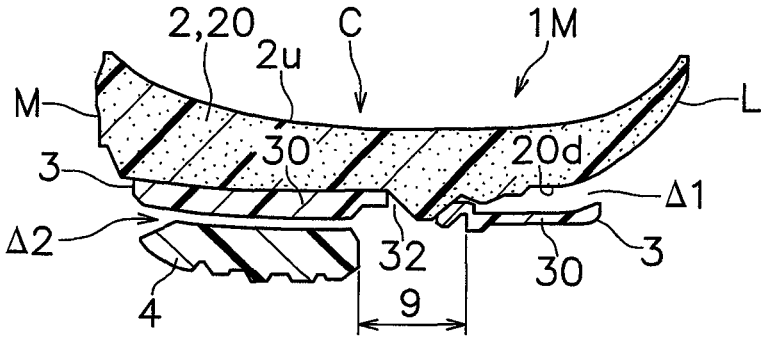
FIG. 5B is a cross-sectional view taken along line VB-VB of FIG. 2.
Figure 5C:
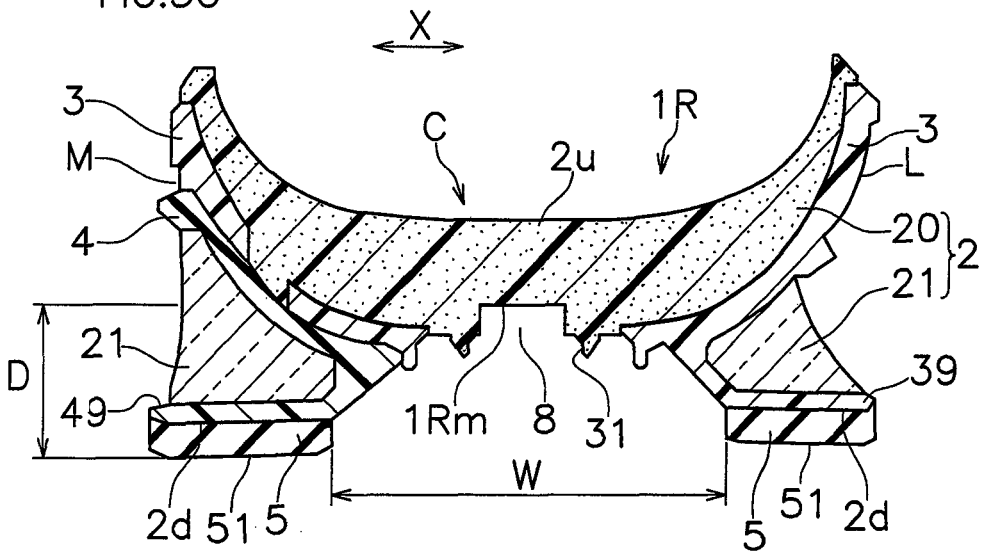
FIG. 5C is a cross-sectional view taken along line VC-VC of FIG. 2.

The outsole 5 is provided in the front foot portion 1F of FIG. 5A and the rear foot portion 1R of FIG. 5C, and is not provided in the middle foot portion 1M of FIG. 5B. The outsole 5 is formed by a rubber which has a better wear resistance and a larger Young's modulus than the midsole 2.

Figure 6:
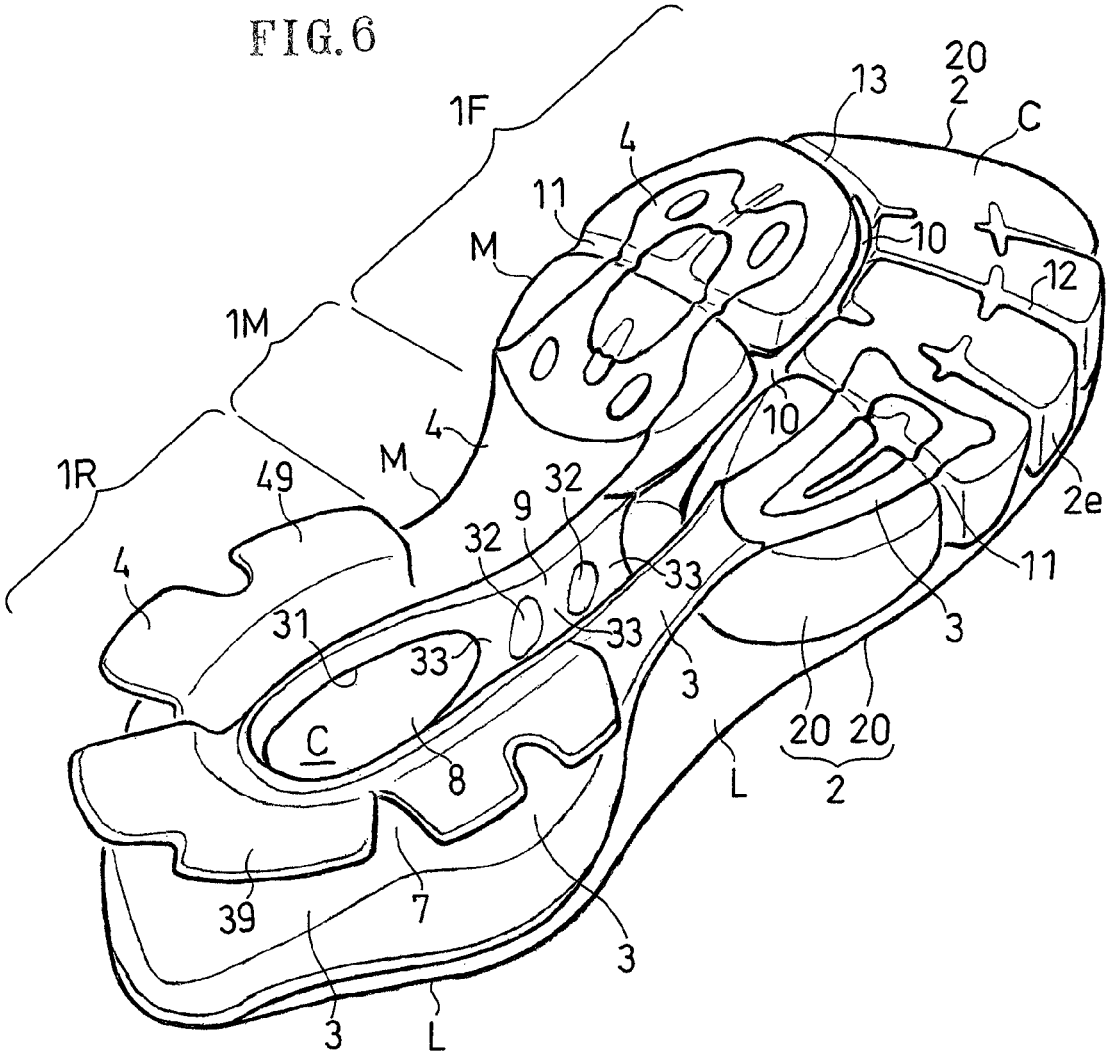
FIG. 6 is a perspective view showing the shoe sole with the outsole removed.
Figure 7:
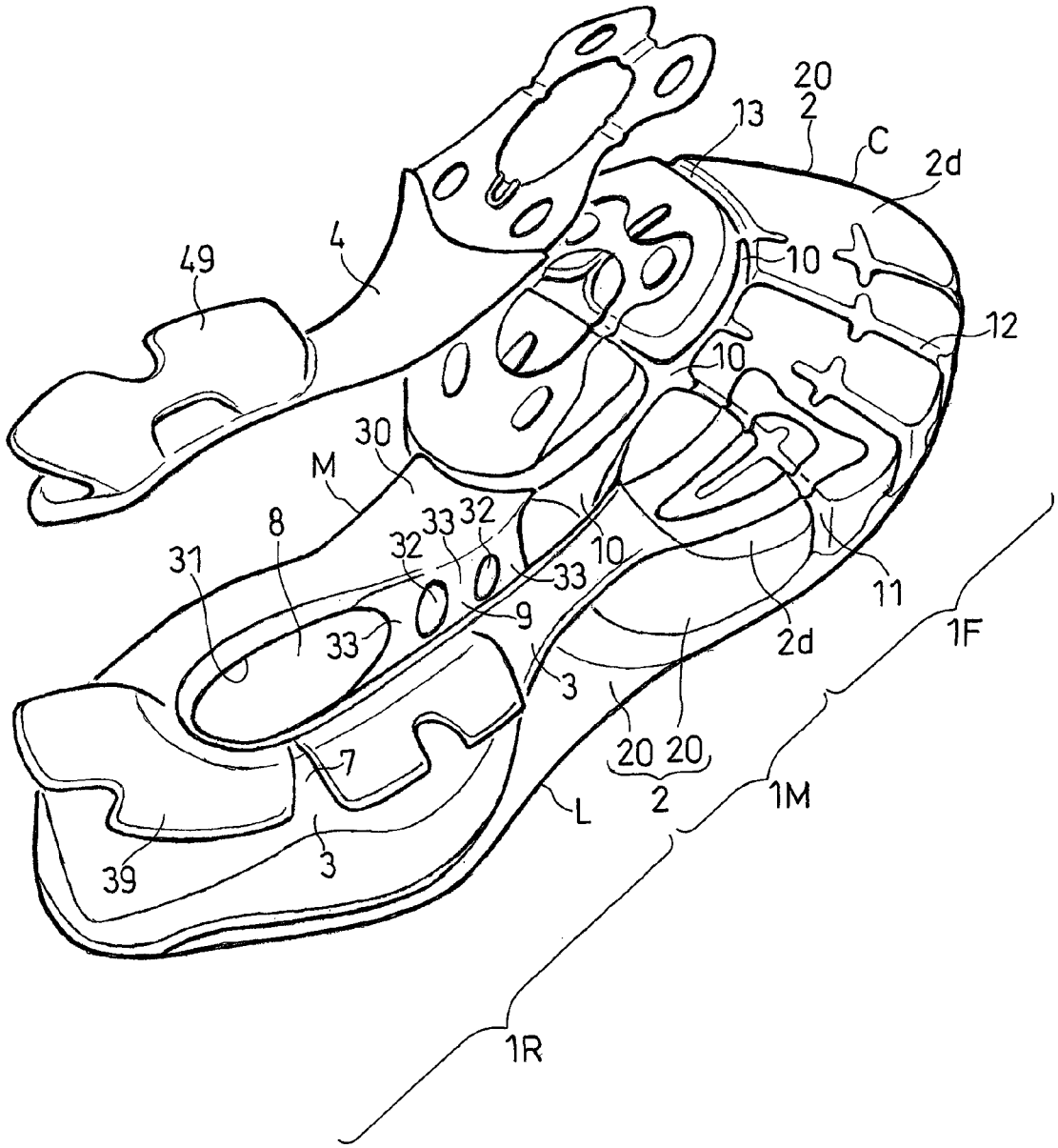
FIG. 7 is an exploded perspective view showing the shoe sole with the outsole removed.
Figure 9:
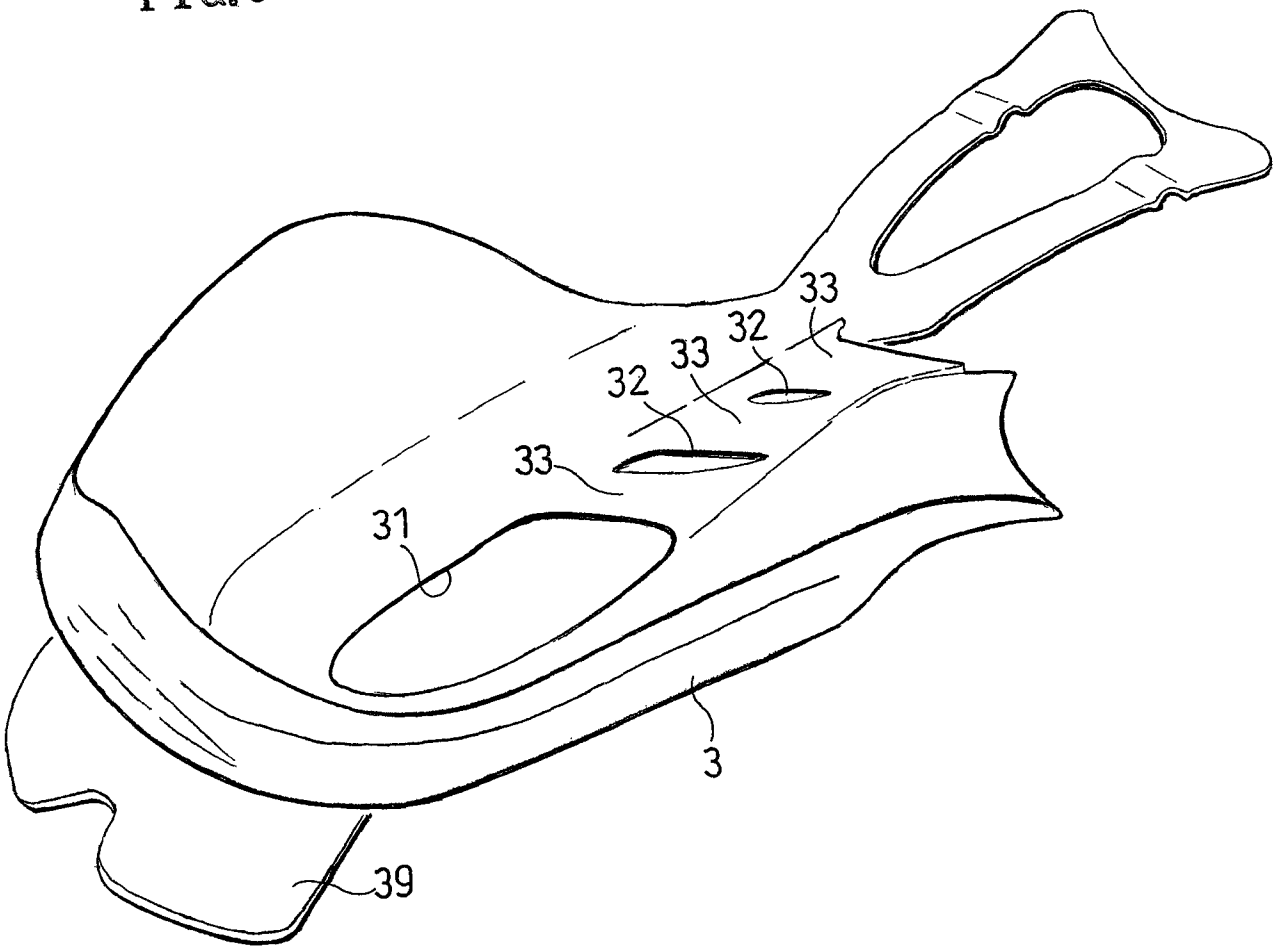
FIG. 9 is a perspective view showing a heel cup with which a reinforcement member is formed integrally.

As shown in FIG. 5C, the heel cup 3 of FIG. 9 and a bridge piece 4 are placed between the midsole 2 and the outsole 5. As shown in FIGS. 6 and 7, the heel cup 3 is bonded to a lower surface 20*d* of the midsole body 20. As shown in FIGS. 7 and 6, the bridge piece 4 is bonded to the lower surface 20*d* of the midsole body 20 and the lower surface of the heel cup 3.

As shown in FIG. 5C, attachment portions 39 and 49 having a generally V-shaped cross section are formed in the heel cup 3 and the bridge piece 4, respectively. The shock-absorbing element 21 is attached to these attachment portions 39 and 49. The outsole 5 is bonded to the lower surface 2*d* of the attachment portions 39 and 49.

The heel cup 3 shown in FIG. 9 is made of a non-foamed resin, and configures (forms) the first member and the support member of the reinforcement member of the present invention. That is, the heel cup 3 of FIG. 5C has such a shape that it is rolled up along the medial side M and the lateral side L of the rear foot portion 1R, and configures the support member for supporting the foot in the rear foot portion 1R while also configuring a part of the reinforcement member to be later described in detail in the middle foot portion 1M of FIG. 5B.

The heel cup 3 of FIG. 9 extends from the rear foot portion 1R toward the middle foot portion 1M, and supports the medial side M and the lateral side L of the foot in the middle foot portion 1M and the rear foot portion 1R. The heel cup 3 includes a first through hole 31 for assisting in making it easier for the upper surface 2*u* of the midsole 2 to sink downward in a central portion 1Rm (FIG. 2) of the rear foot portion 1R.

Figure 2:
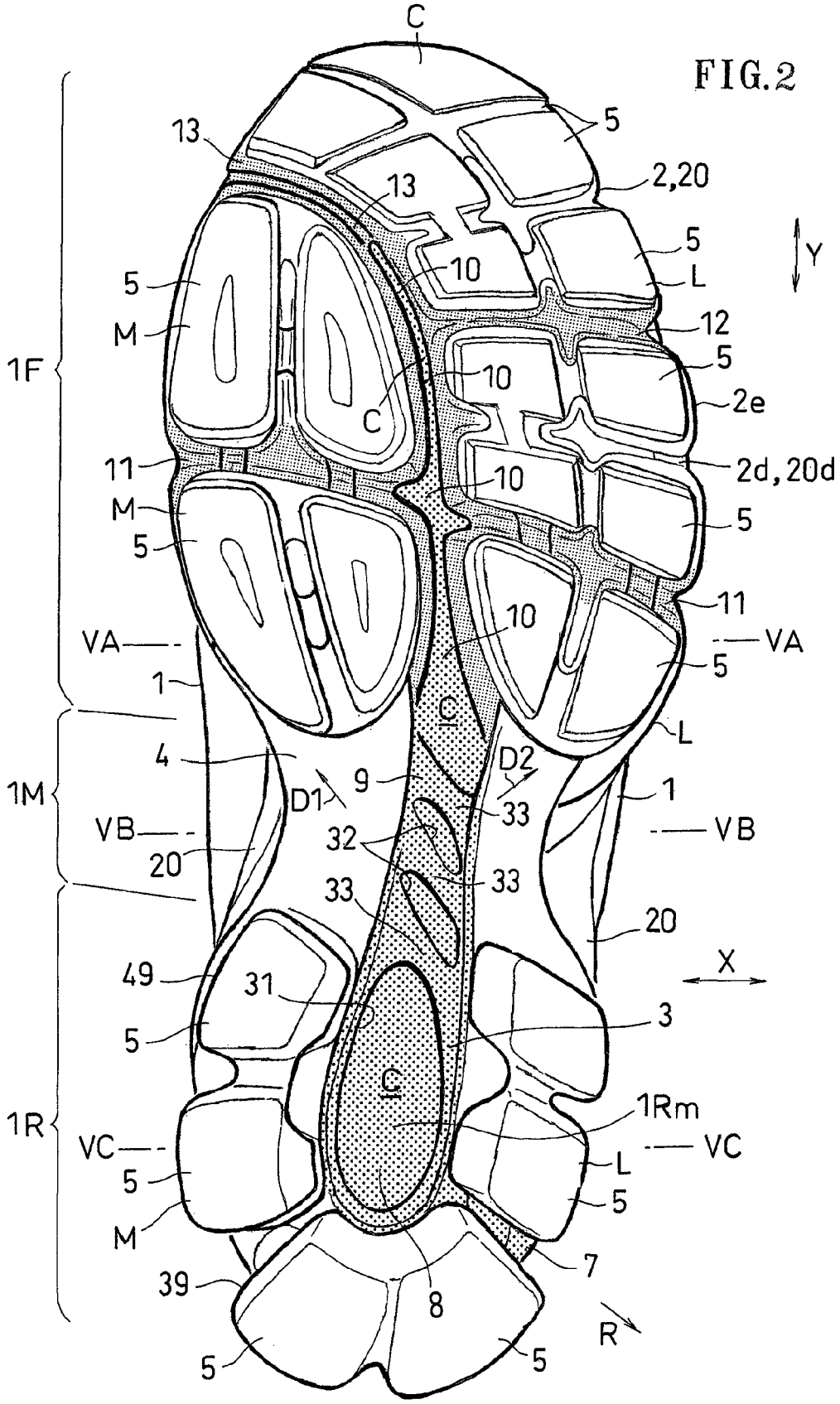
FIG. 2 is a plan view showing the shoe sole of Embodiment 1 of the present invention.
Figure 3:
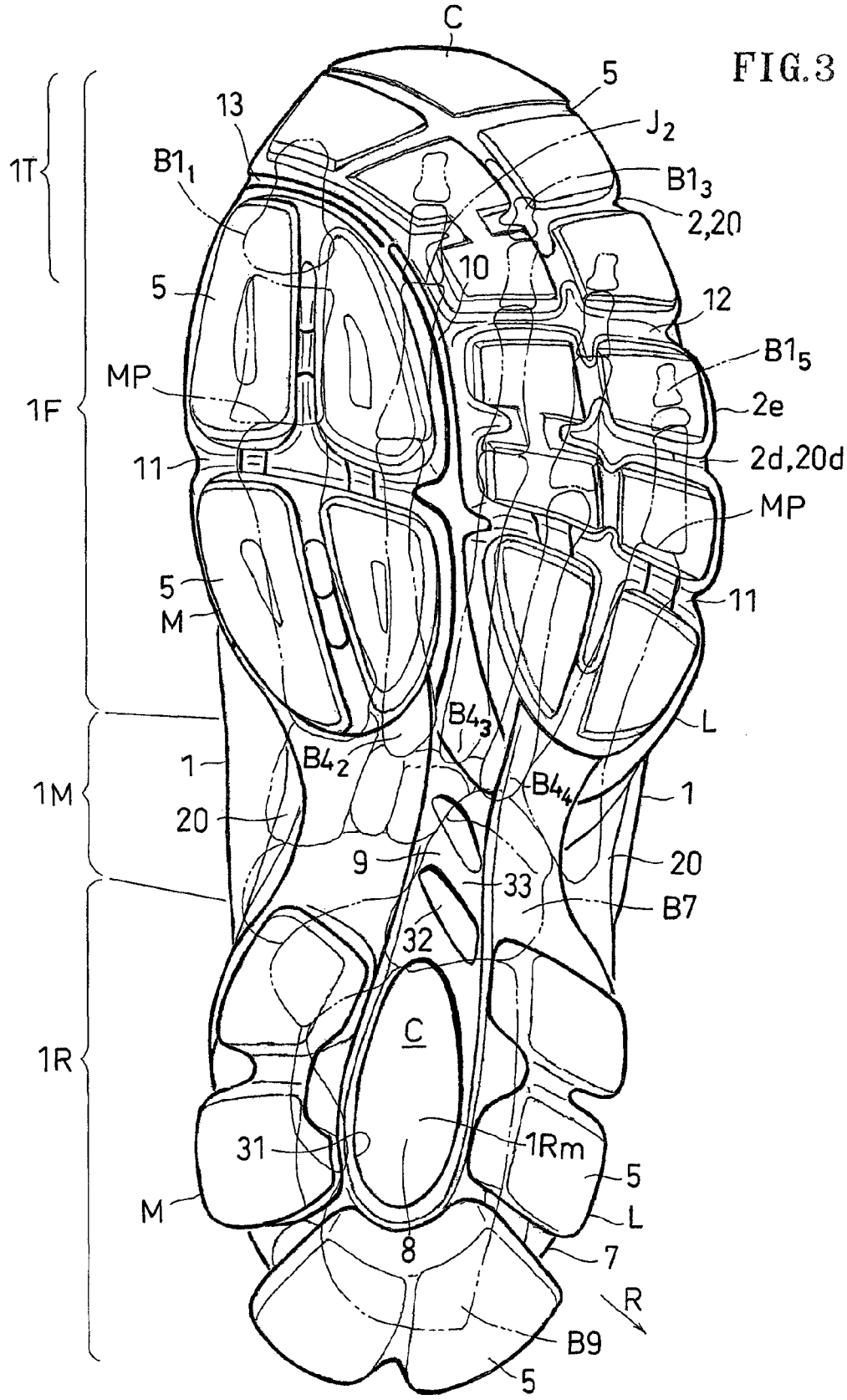
FIG. 3 is a plan view showing the shoe sole together with the bone structure of the foot.
Figure 4:
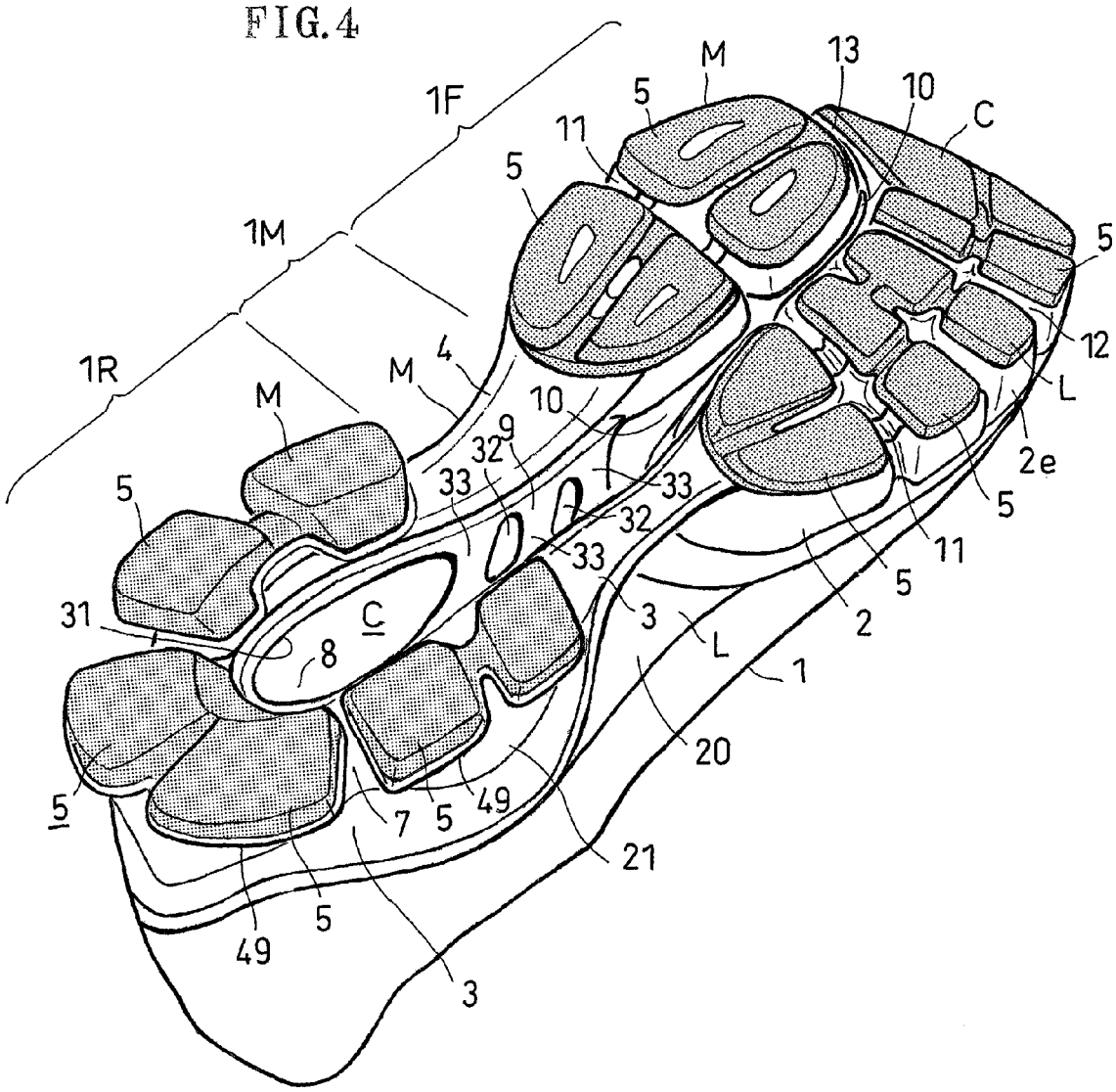
FIG. 4 is a perspective view showing the shoe sole as seen from diagonally below.

As shown in FIGS. 2 to 4, the shock-absorbing element 21, the attachment portion 39 and the outsole 5 are each divided into a plurality of pieces in the rear foot portion 1R, thereby providing a division groove 7. On the lateral side L of the rear foot portion 1R, the division groove 7 of FIG. 3 divides the outsole 5 and the shock-absorbing element 21 along the radial direction R extending in a diagonally rearward direction from the center of the calcaneal bone B9.

Figure 1C:
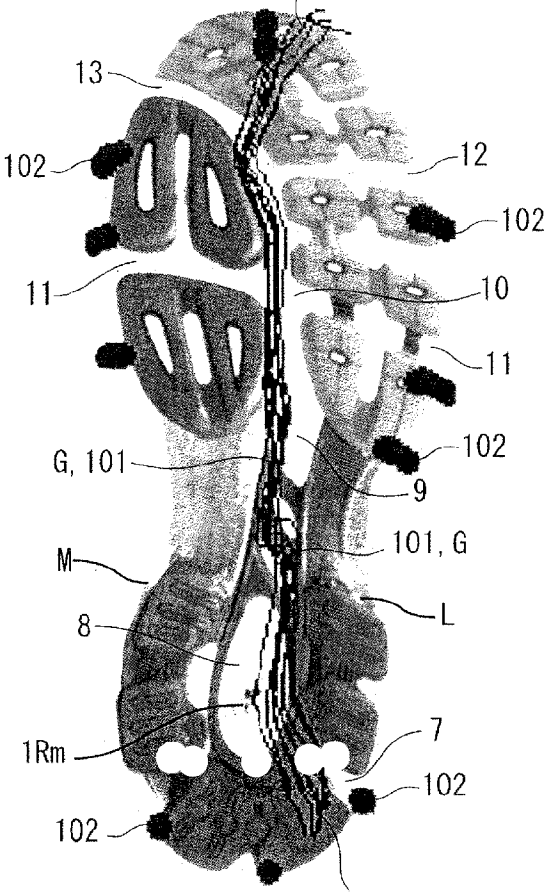
FIG. 1C is a plan view showing a shoe sole of Embodiment 1 of the present invention together with the trace of movement obtained when one runs wearing the shoe sole.

When landing, the lateral side L of the rear foot portion 1R first contacts the ground, and then the center of the heel contacts the ground. In this process, the division groove 7 promotes an increase in the compressive deformation on the lateral side L of the rear foot portion 1R. Thus, a load center G is smoothly guided from the lateral side L of the rear foot portion 1R toward a position lateral to the central portion 1Rm, as shown in FIG. 1C.

As shown by the dotted area of FIG. 2, a depression 8 which does not contact the ground is formed in the rear foot portion 1R by the shock-absorbing element 21 (FIG. 5C), the attachment portions 39 and 49 and the outsole 5. As shown in FIG. 3, the depression 8 is provided in the central portion 1Rm of the rear foot portion 1R, and extends forward from the calcaneal bone B9 along the cuboid bone B7.

Upon landing, the upper surface 2*u* (FIG. 5C) of the midsole 2 sinks downward in the depression 8 and the first through hole 31. Therefore, as shown in FIG. 1C, the load center G moves forward along the depression 8.

Note that as can be seen from FIG. 10, the trace of movement 101 is slightly lateral to the medial-lateral center in the rear foot portion 1R (FIG. 2). Therefore, the depression 8 of FIG. 3 may be provided at the center of the calcaneal bone B9 or at a position lateral to the center. That is, in the rear foot portion 1R, the depression 8 may be provided in the central portion 1Rm between the medial side M and the lateral side L.

As shown by the dotted area of FIG. 2, a band-like area 9 is provided in the middle foot portion 1M extending in the front-rear direction Y between the medial side M and the lateral side L of the shoe sole and smoothly connected with the depression 8. In the middle foot portion 1M, the heel cup 3, the bridge piece 4 and the midsole 2 are provided on the medial side M so that the upper surface 2*u* (FIG. 5B) of the midsole 2 less easily sinks downward due to the load from above than the band-like area 9 and the lateral side L.

The structure will now be described in detail.

In the middle foot portion 1M shown in FIG. 5B, a support portion 30 of the heel cup 3 has a greater thickness on the medial side M than on the lateral side L and in the central portion C. Therefore, the upper surface 2*u* of the midsole 2 less easily sinks downward on the medial side M.

In the central portion C of the middle foot portion 1M shown in FIG. 4, a plurality of second through holes 32 are formed in the heel cup 3. Therefore, the upper surface 2*u* of the midsole 2 of FIG. 5B easily sinks downward in the band-like area 9. Therefore, the load center G is smoothly guided from the depression 8 of the rear foot portion 1R to the band-like area 9 as shown in FIG. 1C.

As shown in FIG. 7, the support portion 30 of the heel cup 3 is bonded to the lower surface 20*d* of the midsole body 20 from the rear foot portion 1R to the middle foot portion 1M on the medial side M. On the other hand, while the support portion 30 of the heel cup 3 shown in FIGS. 7 and 11 is bonded to the lower surface 20*d* (FIG. 11) of the midsole body 20 in the rear foot portion 1R and the front foot portion 1F on the lateral side L, it is not bonded and is spaced apart from the lower surface 20*d* of the midsole body 20 in the middle foot portion 1M on the lateral side L.

As shown in FIG. 5B, in the middle foot portion 1M on the lateral side L, the first gap Δ1 allowing the lower surface 20*d* of the midsole body 20 to be displaced downward is provided between the support portion 30 of the heel cup 3 and the lower surface 20*d* of the midsole body 20. Therefore, the upper surface 2*u* of the midsole 2 of FIG. 5B easily sinks downward on the lateral side L.

In FIG. 6, the bridge piece 4 is provided so as to bridge between the rear end of the front foot portion 1F of the midsole body 20 and the front end of the rear foot portion 1R. The bridge piece 4 serves to make it less easy for the medial side M of the middle foot portion 1M to sink downward than the band-like area 9.

The flexural rigidity (bending stiffness) of the bridge piece 4 shown in FIG. 5B is greater than the flexural rigidity of the medial side M of the middle foot portion 1M of the heel cup 3. The bridge piece 4 of FIG. 7 is bonded to the heel cup 3 in the rear foot portion 1R and bonded to the lower surface 2*d* of the midsole 2 in the front foot portion 1F, while it is spaced apart from the support portion 30 of the heel cup 3 in the middle foot portion 1M. That is, the second gap Δ2 is provided between the heel cup 3 and the bridge piece 4 on the medial side M of the middle foot portion 1M of FIG. 5B.

The bridge piece 4 suppresses the upthrust on the foot sole. The structure of the bridge piece 4 also prevents the bending of the shoe sole on the medial side M of the middle foot portion 1M, and suppresses the pronation of the foot. This suppresses the movement of the load center G to the medial side M in the middle foot portion 1M.

In FIG. 2, a plurality of slant portions 33 are formed in the band-like area 9 of the heel cup 3. In the band-like area 9 of the middle foot portion 1M, the slant portions 33 extend diagonally forward from the lateral side L to the medial side M. In the band-like area 9 of the middle foot portion 1M, the second through holes 32 of the heel cup 3 extend parallel to each other diagonally forward from the lateral side L to the medial side M. The slant portions 33 are formed along the second through holes 32.

With the structure of the slant portions 33, bending of the middle foot portion 1M in the first direction D1 along the direction in which the slant portions 33 extend requires a larger force than bending of the middle foot portion 1M in the second direction D2 perpendicular to the first direction D1. This suppresses the movement of the load center G of FIG. 1 from the band-like area 9 to the medial side M in the middle foot portion 1M. As a result, also during the running action, although the load center G moves from the lateral side toward the medial side in the band-like area 9, it does not move to the medial side M.

As shown by the dotted area of FIG. 2, a longitudinal groove 10 is formed in the midsole body 20 and the heel cup 3 in the front foot portion 1F. The longitudinal groove 10 extends in the front-rear direction Y in the medial-lateral central portion C in the front foot portion 1F to connect with the band-like area 9. The longitudinal groove 10 has generally the same width W (FIG. 5A) and depth D (FIG. 5A) as those of the band-like area 9 at the rear end of the front foot portion 1F and smoothly connects with the band-like area 9. The depth D and the width W of FIG. 5A of the longitudinal groove 10 gradually decrease as the longitudinal groove 10 extends forward from the rear end of the front foot portion 1F, as shown in FIG. 6.

In the treading action during run, the longitudinal groove 10 of FIG. 5A makes it easier for the upper surface 2*u* of the midsole 2 in the central portion C to sink downward in the front foot portion 1F. Therefore, the load center G of FIG. 1C is likely to be localized at the longitudinal groove 10 and smoothly moves from the band-like area 9 to the longitudinal groove 10, and the trace of movement 101 is along the longitudinal groove 10.

In FIG. 3, the longitudinal groove 10 is provided to extend from the rear end of the front foot portion 1F, i.e., the proximal head of the metatarsal bone $B4_2$ to $B4_4$ of the second toe, the third toe or the fourth toe, to the proximal interphalangeal joint $J_2$ of the second toe. The longitudinal groove 10 is curved so as to be generally parallel to a lateral edge 2*e* of the front foot portion 1F of the midsole 2.

Therefore, in the treading action during run, the load center G of FIG. 1C smoothly moves along the longitudinal groove 10 from the medial-lateral center toward the proximal interphalangeal joint $J_2$ of the second toe of FIG. 3 or the distal phalanx $B1_1$ of the first toe.

The depth D of the longitudinal groove 10 of FIG. 5A is about 7 mm to 13 mm. The width W and the depth D of the longitudinal groove 10 are smaller than those of the depression 8 of FIG. 5C.

As shown in FIG. 4, the width W and the depth D of the longitudinal groove 10 gradually and smoothly increase from the front end toward the middle foot portion 1M.

In FIG. 3, a first transverse groove 11 along the metatarsal phalangeal joint MP is provided in the front foot portion 1F so as to extend across the midsole 2 and the outsole 5. On the other hand, on the lateral side of the longitudinal groove 10 in the front foot portion 1F, a second transverse groove 12 is provided extending in a direction across the midsole 2 and the outsole 5 between the distal phalanx $B1_5$ of the fifth toe and the distal phalanx $B1_3$ of the third toe.

The outsole 5 is divided in the front-rear direction by the first transverse groove 11 and the second transverse groove 12. The second transverse groove 12 is formed so as to be more spaced apart from the first transverse groove 11 of FIG. 2 as it extends toward the lateral edge 2*e* of the midsole 2.

As shown by the dotted area in FIG. 2, an extension groove 13 is connected with the tip of the longitudinal groove 10. The extension groove 13 of FIG. 3 is curved toward the medial side M of the foot as it extends forward from the tip of the longitudinal groove 10 so as to pass through the distal phalanx $B1_1$ of the first toe or the vicinity thereof.

A portion (tip portion) of the longitudinal groove 10, the second transverse groove 12 and the extension groove 13 partition the tiptoe portion 1T and the tread portion of the shoe sole from each other by the grooves. Therefore, when the foot takes off, the shoe sole easily bends along the grooves 10, 12 and 13. As a result, the load center G of FIG. 1C moves along a predetermined kickout direction.

In FIG. 2, deep groove portions, the band-like area 9 and the depression 8 are denoted by coarsely-dotted areas. On the other hand, shallow groove portions of the longitudinal groove 10, the first transverse groove 11, the second transverse groove 12 and the extension groove 13 are denoted by finely-dotted areas. That is, the deepest portion of the longitudinal groove 10 is deeper than the first transverse groove 11, the second transverse groove 12 and the extension groove 13.

Next, a test in which athletic shoes of the present embodiment were worn by the subject will be described.

The subject ran on the track at 3.5 min/km, and the trace of movement 101 of the load center G during run was measured. The trace of movement 101 is shown in FIG. 1C.

As can be seen from FIG. 1C, the load center G smoothly moves forward along the division groove 7, the depression 8, the band-like area 9 and the longitudinal groove 10. Particularly, in the middle foot portion 1M, the load center G moves forward with no substantial bending of the trace of movement 101. In the front foot portion 1F, the lockout direction of the foot is stable.

While preferred embodiments have been described above with reference to the drawings, various obvious changes and modifications will readily occur to those skilled in the art upon reading the present specification.

For example, it is not necessary to provide the slant portions 33. It is not necessary to provide the first and second through holes 31 and 32. The slant portions 33 may be formed by ribs extending in the first direction D1, without forming the second through holes 32.

In the middle foot portion 1M, the rigidity of the lateral side L may be greater than that of the band-like area 9. Without providing the second through hole 32, the heel cup 3 or the reinforcement member may be formed to be thinner in the portion of the band-like area 9, or the heel cup 3 and the reinforcement member may be provided so that they are not bonded to the lower surface of the midsole 2 in the portion of the band-like area 9.

It is not necessary to provide a gel in a portion of the midsole 2. For example, a pod-like part or a foamed resin may be provided instead of the gel.

It is not necessary to provide the heel cup 3. A portion of the reinforcement member may be formed by a foamed material.

It is not necessary to provide the division groove 7, the first transverse groove 11, the second transverse groove 12 and the extension groove 13.

Thus, such changes and modifications are deemed to fall within the scope of the present invention, which is defined by the appended claims.

The present invention is applicable to athletic shoes that are worn in daily lives, sports and competitions.

The invention claimed is:

1. A shoe sole of an athletic shoe suitable for efficient running, wherein:

the shoe sole has a front foot portion, a middle foot portion and a rear foot portion continuous with one another in a front-rear direction of a foot, and has a medial side, a lateral side and a central portion between the medial side and the lateral side continuous with one another in a width direction of the foot, the shoe sole comprising:

a midsole having an upper surface and a lower surface and absorbing an impact of landing; and an outsole placed below the midsole, the outsole having a ground contact surface;

the midsole includes a midsole body formed by a foamed resin in the front foot portion and the middle foot portion;

the outsole is separately provided in the front foot portion and the rear foot portion without being provided in the middle foot portion;

the middle foot portion supports an arch of the foot, and a reinforcement member is provided in the middle foot portion for suppressing lowering of the arch;

the rear foot portion has a depression extending forward from a part covering a calcaneal bone of the foot from below and extending upward relative to the ground contact surface so as not to touch a ground;

the middle foot portion has a band-like area extending in the front-rear direction in the central portion so as to be continuous with the depression, the band-like area arranged above the ground contact surface so as not to touch the ground;

a hardness of the reinforcement member is greater than a hardness of the midsole body, the reinforcement member is attached to the midsole body in the medial side of the middle foot portion, and the band-like area has a non-attached part that the reinforcement member is unattached to the midsole body in;

the reinforcement member and the midsole are provided in the middle foot portion so that the upper surface of the midsole on the medial side is more resistant to sinking downward due to a load from above than the upper surface of the midsole in the non-attached part in the band-like area;

in the front foot portion, the outsole has a longitudinal groove extending in the front-rear direction in the central portion so as to be continuous with the band-like area;

a depth of the longitudinal groove is 5 mm to 20 mm;

the longitudinal groove is provided to extend from a rear end of the front foot portion to a part covering a proximal interphalangeal joint of a second toe of the foot from below;

the longitudinal groove is curved so as to be generally parallel to a lateral edge of the front foot portion of the midsole and terminate on the medial side of the front foot portion;

a width and the depth of the longitudinal groove are smaller than those of the depression; and the depression, the band-like area and the longitudinal groove are continuous with one another in the front-rear direction.

2. A shoe sole of an athletic shoe according to claim 1, further comprising:

a support member made of a non-foamed resin, having such a shape that it is rolled up along the medial side and the lateral side of the rear foot portion, and supporting the foot in the rear foot portion, wherein:

the support member includes a through hole that facilitates the upper surface of the midsole sinking downward in a central portion of the rear foot portion.

3. A shoe sole of an athletic shoe according to claim 1, further comprising:

a support member extending from the rear foot portion toward the middle foot portion, supporting the medial side and the lateral side of the foot in the middle foot portion, and supporting the medial side and the lateral side of the foot in the rear foot portion, wherein:

the support member forms a part or whole of the reinforcement member in the middle foot portion; and the support member includes a through hole portion that facilitates the upper surface of the midsole sinking downward in a central portion of the middle foot portion and the rear foot portion.

4. A shoe sole of an athletic shoe according to claim 3, wherein a bridge piece, forming a part of the reinforcement member, is provided so as to bridge between the rear end of the front foot portion of the midsole body and a front end of the rear foot portion, and the bridge piece serves to make the medial side of the middle foot portion more resistant to sinking downward than the band-like area of the middle foot portion.

5. A shoe sole of an athletic shoe according to claim 3, wherein:

the midsole further includes the midsole body in the middle foot portion; and the support member is bonded to the lower surface of the midsole body on the medial side of the middle foot portion without being bonded to the lower surface of the midsole body and is spaced apart from the lower surface of the midsole body on the lateral side of the middle foot portion.

6. A shoe sole of an athletic shoe according to claim 3, wherein:

the support member further includes a slant portion extending diagonally forward from the lateral side toward the medial side in the band-like area of the middle foot portion; and bending of the middle foot portion in a first direction along a direction in which the slant portion extends requires a larger force than bending of the middle foot portion in a second direction perpendicular to the first direction.

7. A shoe sole of an athletic shoe according to claim 6, wherein the through hole portion of the support member includes a plurality of through holes parallel to one another extending diagonally forward from the lateral side toward the medial side in the band-like area of the middle foot portion, and the slant portion is formed along the through holes.

8. A shoe sole of an athletic shoe according to claim 1, wherein:

a first transverse groove along a part covering a metatarsal phalangeal joint of the foot from below is provided in the front foot portion so as to extend across the outsole; and the first transverse groove is formed by dividing the outsole in the front-rear direction.

9. A shoe sole of an athletic shoe according to claim 8, wherein:

a second transverse groove extending in a direction across the outsole between a part covering a tip of a fifth toe of the foot from below and a part covering a tip of a third toe of the foot from below is provided on the lateral side of the front foot portion; and the second transverse groove is formed so as to be more spaced apart from the first lateral groove as it extends toward the lateral edge of the midsole.

10. A shoe sole of an athletic shoe according to claim 1, wherein the longitudinal groove is formed so that the width and the depth thereof gradually and smoothly increase from a front end of the longitudinal groove toward the middle foot portion.

11. A shoe sole of an athletic shoe according to claim 1, wherein the reinforcement member includes a first member attached to the lower surface of the midsole body on the medial side of the middle foot portion to support the medial side of the foot, and a second member placed below the first member on the medial side of the middle foot portion.

12. A shoe sole of an athletic shoe according to claim 1, wherein:

a soft, shock-absorbing element having a smaller Young's modulus than the foamed material is placed on the lateral side of the rear foot portion as a part of the midsole; and a division groove dividing the outsole and the shock-absorbing element along a radial direction extending in a diagonally rearward direction from a center of a part covering a heel of the foot from above is provided on the lateral side of the rear foot portion.

13. A shoe sole of an athletic shoe according to claim 1, wherein:

the depression, the band-like area, and the longitudinal groove are smoothly continuous with one another in the front-rear direction by a front end of the depression being continuous with a rear end of the band-like area and a front end of the band-like area being continuous with a rear end of the longitudinal groove.

14. A shoe sole of an athletic shoe according to claim 1, wherein:

the reinforcement member is placed on the lower surface of the midsole, and a thickness of the reinforcement member is larger in the medial side than that in the band-like area.

15. A shoe sole of an athletic shoe according to claim 1, wherein:

the reinforcement member has a through hole in an area corresponding to the band-like area.

16. A shoe sole of an athletic shoe according to claim 1, wherein:

a thickness of the midsole is larger in the medial side than that in the band-like area.

17. A shoe sole of an athletic shoe suitable for efficient running, wherein:

the shoe sole has a front foot portion, a middle foot portion and a rear foot portion continuous with one another in a front-rear direction of a foot, and has a medial side, a lateral side and a central portion between the medial side and the lateral side continuous with one another in a width direction of the foot, the shoe sole comprising:

a midsole having an upper surface and a lower surface and absorbing an impact of landing; and an outsole placed below the midsole, the outsole having a ground contact surface;

the midsole includes a midsole body formed by a foamed resin in the front foot portion and the middle foot portion;

the outsole is separately provided in the front foot portion and the rear foot portion without being provided in the middle foot portion;

the middle foot portion supports an arch of the foot, and a reinforcement member is provided in the middle foot portion for suppressing lowering of the arch;

the rear foot portion has a depression extending forward from a part covering a calcaneal bone of the foot from below and extending upward relative to the ground contact surface so as not to touch a ground;

the middle foot portion has a band-like area extending in the front-rear direction in the central portion so as to be continuous with the depression, the band-like area arranged above the ground contact surface so as not to touch the ground;

in the middle foot portion, the reinforcement member is attached to the medial side of the lower surface of the midsole body and the reinforcement member has a non-attached part that is spaced apart from the lower surface of the midsole body without being attached to the lower surface in the band-like area, in the front foot portion, the outsole has a longitudinal groove extending in the front-rear direction in the central portion so as to be continuous with the band-like area;

a depth of the longitudinal groove is 5 mm to 20 mm;

the longitudinal groove is provided to extend from a rear end of the front foot portion to a part covering a proximal interphalangeal joint of a second toe of the foot from below;

the longitudinal groove is curved so as to be generally parallel to a lateral edge of the front foot portion of the midsole;

a width and the depth of the longitudinal groove are smaller than those of the depression; and the depression, the band-like area and the longitudinal groove are continuous with one another in the front-rear direction.

18. A shoe sole of an athletic shoe according to claim 17, wherein:

the longitudinal groove terminates on the medial side of the front foot portion.

19. A shoe sole of an athletic shoe suitable for efficient running, wherein:

the shoe sole has a front foot portion, a middle foot portion and a rear foot portion continuous with one another in a front-rear direction of a foot, and has a medial side, a lateral side and a central portion between the medial side and the lateral side continuous with one another in a width direction of the foot, the shoe sole comprising:

a midsole having an upper surface and a lower surface and absorbing an impact of landing; and an outsole placed below the midsole, the outsole having a ground contact surface;

the midsole includes a midsole body formed by a foamed resin in the front foot portion and the middle foot portion;

the outsole is separately provided in the front foot portion and the rear foot portion without being provided in the middle foot portion;

the middle foot portion supports an arch of the foot, and a reinforcement member is provided in the middle foot portion for suppressing lowering of the arch;

the rear foot portion has a depression extending forward from a part covering a calcaneal bone of the foot from below and extending upward relative to the ground contact surface so as not to touch a ground;

the middle foot portion has a band-like area extending in the front-rear direction in the central portion so as to be continuous with the depression, the band-like area arranged above the ground contact surface so as not to touch the ground;

a hardness of the reinforcement member is greater than a hardness of the midsole body, the reinforcement member is attached to the midsole body in the medial side of the middle foot portion and the band-like area, and, in the band-like area, the reinforcement member has a through hole portion that exposes the lower surface of the midsole body;

the reinforcement member and the midsole are provided in the middle foot portion so that the upper surface of the midsole on the medial side is more resistant to sinking downward due to a load from above than the upper surface of the midsole in the non-attached part in the band-like area;

in the front foot portion, the outsole has a longitudinal groove extending in the front-rear direction in the central portion so as to be continuous with the band-like area;

a depth of the longitudinal groove is 5 mm to 20 mm;

the longitudinal groove is provided to extend from a rear end of the front foot portion to a part covering a proximal interphalangeal joint of a second toe of the foot from below;

the longitudinal groove is curved so as to be generally parallel to a lateral edge of the front foot portion of the midsole;

a width and the depth of the longitudinal groove are smaller than those of the depression; and the depression, the band-like area and the longitudinal groove are continuous with one another in the front-rear direction.

20. A shoe sole of an athletic shoe according to claim 19, wherein:

the longitudinal groove terminates on the medial side of the front foot portion.

21. A shoe sole of an athletic shoe according to claim 1, wherein:

in the band-like area, the reinforcement member has a through hole portion that exposes the lower surface of the midsole body.

* * * * *